United States Patent [19]

Aubin et al.

[11] Patent Number: 4,971,131

[45] Date of Patent: Nov. 20, 1990

[54] COUNTERGRAVITY CASTING USING PARTICULATE FILLED VACUUM CHAMBERS

[75] Inventors: Charles P. Aubin; Joseph A. Knapke, both of Saginaw; John G. Kubisch, Midland, all of Mich.

[73] Assignee: General Motors Corporation, Detroit, Mich.

[21] Appl. No.: 399,219

[22] Filed: Aug. 28, 1989

[51] Int. Cl.[5] ..... B22C 9/02; B22C 9/04; B22D 18/06

[52] U.S. Cl. ..... 164/7.1; 164/34; 164/63; 164/255

[58] Field of Search ..... 164/7.1, 7.2, 34, 35, 164/36, 63, 160.1, 160.2, 255

[56] References Cited

U.S. PATENT DOCUMENTS

| | | | |
|---|---|---|---|
| 3,059,294 | 10/1962 | Dunn et al. . | |
| 3,181,213 | 5/1965 | Schaible et al. . | |
| 3,557,867 | 1/1971 | Krzyzanowski | 164/255 |
| 3,581,802 | 6/1971 | Krzyzanowski | 164/34 |
| 4,085,790 | 4/1978 | Wittmoser | 164/7 |
| 4,182,395 | 1/1980 | Buhler | 164/7.1 |
| 4,340,108 | 7/1982 | Chandley et al. | 164/63 |
| 4,566,521 | 1/1986 | Uzaki et al. | 164/160.1 |
| 4,606,396 | 8/1986 | Chandley et al. | 164/255 |
| 4,612,968 | 9/1986 | Ashton et al. | 164/7.1 X |
| 4,616,689 | 10/1986 | Denis | 164/34 |
| 4,616,691 | 10/1986 | Voss | 164/255 |
| 4,658,880 | 4/1987 | Voss | 164/255 |
| 4,787,434 | 11/1988 | Cleary et al. | 164/34 |
| 4,830,085 | 5/1989 | Cleary et al. | 164/255 |
| 4,848,439 | 7/1989 | Plant | 164/34 X |
| 4,874,029 | 10/1989 | Chandley et al. | 164/34 |

OTHER PUBLICATIONS

Kubo Y. et al, "Molding Unbonded Sand with Vacuum-The V-Process" in *American Foundry Society Transactions,* No. 73-126, 1973, pp. 529-544.

*Primary Examiner*—Richard K. Seidel
*Assistant Examiner*—J. Reed Batten, Jr.
*Attorney, Agent, or Firm*—Reising, Ethington, Barnard, Perry & Milton

[57] ABSTRACT

Particulate mold material, such as binderless foundry sand, is vacuumed upwardly from a particulate bed into an open bottom container about one or more gas permeable molds or destructible patterns in the container to form a casting assembly adapted for immersion in an underlying molten metal pool to effect countergravity casting of molten metal.

28 Claims, 7 Drawing Sheets

COUNTERGRAVITY CASTING USING PARTICULATE FILLED VACUUM CHAMBERS

FIELD OF THE INVENTION

This invention relates to the vacuum-assisted countergravity casting of molten metal and in particular, to a method for vacuuming particulate mold material into an open bottom container about one or more gas permeable molds or destructible patterns to form a casting assembly adapted for immersion in an underlying molten metal pool for countergravity casting.

BACKGROUND OF THE INVENTION

A vacuum-assisted countergravity casting process using a gas permeable, self-supporting mold sealingly received in a vacuum housing is described in such patents as the Chandley et al U.S. Pat. Nos. 4,340,108 issued July 20, 1982 and 4,606,396 issued Aug. 19, 1986. That countergravity casting process involves providing a mold having a porous, gas permeable upper mold member (cope) and a lower mold member (drag) sealingly engaged together at a horizontal parting plane, sealing the mouth of a vacuum housing to a surface of the mold such that a vacuum chamber formed in the housing confronts the gas permeable upper mold member, immersing the bottom side of the lower mold member in an underlying molten metal pool and evacuating the vacuum chamber to draw molten metal through one or more ingate passages in the lower mold member into one or more mold cavities formed between the upper and lower mold members.

The mold and the vacuum housing typically are sealed together to form a casting assembly using a gasket seal compressed between the bottom lip of the vacuum housing and an upwardly facing sealing surface or flange formed on the mold, either on the lower or upper mold member. Various mechanical clamping mechanisms have been provided for clamping the vacuum housing and the mold together to compress the seal therebetween; e.g., as shown in U.S. Pat. Nos. 4,340,108; 4,616,691 and 4,658,880.

The need for such mold-to-vacuum housing sealing systems complicates the casting assembly as well as the casting mold. In this latter regard, the mold must include the sealing surface/flange needed to cooperate with the gasket seal and oftentimes attachment features, such as threaded lugs, needed to cooperate with the mechanical clamping mechanism. Moreover, the need for such mechanical sealing systems limits to some extent the variety of mold designs which can be used with the system.

In the countergravity casting process described in the aforementioned patents, the lower and upper mold members typically are engaged at a horizontal parting plane therebetween in such a manner as to substantially prevent or minimize leakage of molten metal from the mold cavity at the parting plane during casting since such leakage can result in the production of unacceptable castings and damage to the vacuum housing and associated vacuum components of the casting assembly. To this end, the lower and upper mold members are often adhered (e.g., glued) together at the horizontal mold parting plane by a gluing process which is both expensive and time consuming.

Moreover, in practicing the aforementioned vacuum countergravity process, the mold is subjected to flexural and other stresses when the vacuum chamber confronting the upper mold member is evacuated and the molten metal is drawn upwardly into the mold cavity. The thickness and thus the strength of the walls of the casting mold must be sufficient to withstand these and other stresses imposed on the mold during casting to prevent cracking or total fracture of the mold and resultant molten metal leakage from the mold cavity into the vacuum chamber. A reduction in both the thickness of the mold walls and the outside structural features needed for sealing to the mouth of the vacuum chamber would reduce the amount of expensive resin-bonded sand employed in the mold and thus improve the economies of the casting process. Moreover, without such excess mold material and structural features, more of the volume of the vacuum chamber would be available to accommodate more molds and hence increase the number of castings possible per casting cycle for a given size vacuum chamber.

Recent improvements in the vacuum-assisted countergravity casting process, represented by copending applications Ser. No. 191,544 and now U.S. Pat No. 4,874,029 and Ser. No. 346,627 of George D. Chandley and of common assignee herewith, have achieved substantial increases in the productivity and economies of the process by overcoming the drawbacks discussed above; i.e., by eliminating the need for large quantities of costly mold-making particulate (e.g., resin-containing sand), the need for mechanical mold-to-vacuum housing sealing/clamping systems and the need to glue the mold members together to minimize leakage of molten metal at the parting plane therebetween. A reduction in both the thickness of the mold walls and the complexity of the exterior structural features needed on the mold has resulted from these improvements and allowed more molds/mold cavities to be housed within a given size vacuum chamber than previously possible.

In these copending applications, one or more gas permeable molds (e.g., resin-bonded sand molds) or one or more destructible patterns (e.g., polystyrene patterns) are surrounded in a mass of particulate mold material (preferably binderless foundry sand) held within an open bottom container by establishment of a suitable negative pressure differential between the interior and exterior of the container. The particulate mass and molds/patterns are held in the container such that lower molten metal inlets of the molds/patterns are exposed at the open bottom end of the container for immersion in an underlying molten metal pool while the interior of the container is evacuated to effect countergravity casting of the molten metal upwardly to replace the patterns in the particulate mass or into the cavities of the molds in the mass. After the molten metal has solidified and the metal-filled container is moved to an unload station, the vacuum in the interior of the container is released to permit ready discharge of the particulate mass, castings and molds, if used, through the open bottom end of the container.

One technique used for assembling the patterns/molds and the surrounding particulate mass in the container involves inverting the container such that its open end faces upwardly, positioning the patterns/molds in the container and then gravity filling the container with binderless foundry sand through the upwardly facing open end to surround the patterns/molds in a foundry sand mass. Thereafter, the interior of the container is evacuated to establish the required negative pressure differential to hold the foundry sand in the container about the patterns/molds upon inversion of the container to orient its open end downwardly for countergravity casting.

In another assembly technique used, an open ended can is initially placed about the patterns/molds and the particulate mold material (e.g., foundry sand) is introduced into the container through the open top end thereof and falls by gravity about the patterns/molds to surround them in the particulate mass. The particulate mass is leveled with the open top end of the container and a separate vacuum box is sealingly attached on the top of the particulate-filled container to provide a casting assembly for immersion in the underlying molten metal to effect countergravity casting.

In view of the continuing desire for improvements in the productivity and economies of the vacuum-assisted countergravity casting process, a reduction in the number of operations and equipment requirements for assembling the casting assembly would be welcomed. In particular, it would be desirable to substantially reduce the number of processing steps and the overall time required to carry out assembly of the patterns/molds and surrounding particulate mass in the open bottom container. It would also be desirable to eliminate the need for complex multi-part containers requiring sealing between components thereof as well as associated handling and clamping equipment required for multi-part containers.

It is an object of the present invention to provide an improved method of assembling one or more casting molds or destructible patterns and a surrounding particulate mass in an open bottom container to form a casting assembly for practicing the aforementioned vacuum-assisted countergravity casting process.

It is another object of the present invention to reduce the number of processing steps and the time involved in assembling casting molds/patterns and a surrounding particulate mass in the open bottom container for practicing the aforementioned vacuum-assisted countergravity casting process.

It is still another object of the invention to reduce the equipment requirements involved in assembling molds/patterns and a surrounding particulate mass in an open bottom container for practicing the aforementioned vacuum-assisted countergravity casting process.

SUMMARY OF THE INVENTION

The invention contemplates a method of countergravity casting of molten metal wherein an open bottom container is disposed about one or more casting molds or destructible patterns (each mold or pattern constituting means for forming a metal-receiving mold cavity and a molten metal inlet to the mold cavity) in such a manner that the open bottom end of the container is disposed proximate the inlet and that the interior of the container is communicated to a source of particulate mold material, preferably a bed of substantially binderless foundry sand. The interior of the container is then evacuated sufficiently to draw the particulate material from the source into the container about the mold cavity and inlet forming means (i.e., about the casting mold or destructible pattern). The particulate-filled container is then separated from communication with the source of the particulate material while the interior of the container is evacuated sufficiently to hold the particulate material in the container about the mold cavity and inlet forming means.

After separation, the particulate-filled container is ready for countergravity casting by immersing the molten metal inlet in an underlying molten metal pool and drawing the molten metal upwardly through the inlet into the mold cavity for solidification therein. After casting, the particulate and metal-filled container is moved to an unload station where the vacuum in the container is released to enable discharge of the particulate material, solidified metal castings and casting mold, if used, for further processing, such as casting shakeout.

In accordance with one embodiment of the invention, the container is communicated to the source of particulate material by setting the container on a bed of the particulate material about the mold cavity and inlet forming means (i.e., about the casting mold or destructible pattern) with the open bottom end embedded in the bed for vacuum sealing purposes. Typically, the mold cavity and inlet forming means is first set on the bed and the container is then lowered thereabout to embed the open bottom end in the bed.

In accordance with another embodiment of the invention, the container is communicated to the source of particulate material by interposing one or more suction hoses between the interior of the container and the source. In this embodiment, the container and the mold cavity and inlet forming means are disposed on a sealing plate with the suction hoses connected at one end to the plate and immersed at the other end in the particulate bed.

The objects and advantages of the present invention enumerated hereinabove will become more readily apparent from the following detailed description and drawings.

DETAILED DESCRIPTION OF CERTAIN EMBODIMENTS

Figure 1A:
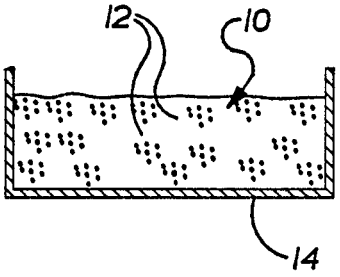
FIGS. 1A through 1G are sectioned elevational views illustrating one embodiment of the method of the invention.
Figure 1B:
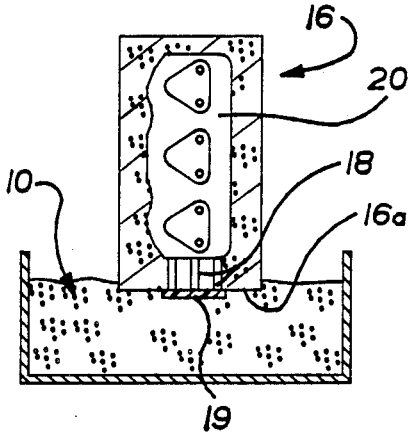

FIGS. 1A through 1G illustrate one embodiment of the method of the present invention. In particular, a bed 10 (or other source) of particulate mold material 12 (e.g., substantially binderless silica foundry sand) is provided in a receptacle 14. A self-supporting, gas permeable casting mold !6 is placed on the bed 10 as shown in FIG. 1B with the molten metal inlets or ingates 18 oriented downwardly beneath a mold cavity 20 formed thereabove in the mold 16. Prior to placement on the particulate bed 10, the inlets 18 are sealed by adhering destructible tape 19 on the underside **16*a* of the mold over the inlets 18. Commercially available glass tape and masking tape available from 3-M Co., St. Paul, Minn., have been successfully used to seal the inlets 18. Alternately, the entire underside 16a of the mold 16 can be covered by a barrier sheet (e.g., aluminum foil) to seal the inlets 18**. Other inlet sealing means may also be employed in practicing the invention.

The mold 16 may comprise a conventional resin bonded, gas permeable, self-supporting cope and drag sealingly engaged at a horizontal parting plane. Preferably, the mold 16 comprises a plurality of resin bonded, gas permeable, self-supporting, plate-like mold members stacked side-by-side and sealingly engaged at vertical or horizontal parting planes sans glue to form a plurality of mold cavities, for example, as disclosed in copending application Ser. No. 346,627 of common assignee herewith, the teachings of which are incorporated herein by reference.

The resin bonded molds can be made in accordance with known mold-making practice wherein a mixture of sand or equivalent particles and bonding material is formed to shape and cured or hardened against contoured metal pattern plates (not shown) having the desired complementary contour or profile to form the parting faces with portions of the molten metal inlets 18 and the mold cavity 20. The bonding material may comprise inorganic or organic thermal or chemical setting plastic resin or equivalent bonding material. The bonding material is usually present in a minor percentage of the mixture, such as about 5% by weight or less of the mixture.

However, the invention is not limited to resin-bonded, multi-part molds and may be practiced using other types of one-part or multi-part molds used for the countergravity casting of molten metal. Moreover, as will be explained hereinbelow, the invention envisions use of one or more destructible patterns in lieu of the preformed casting molds.

Figure 1C:
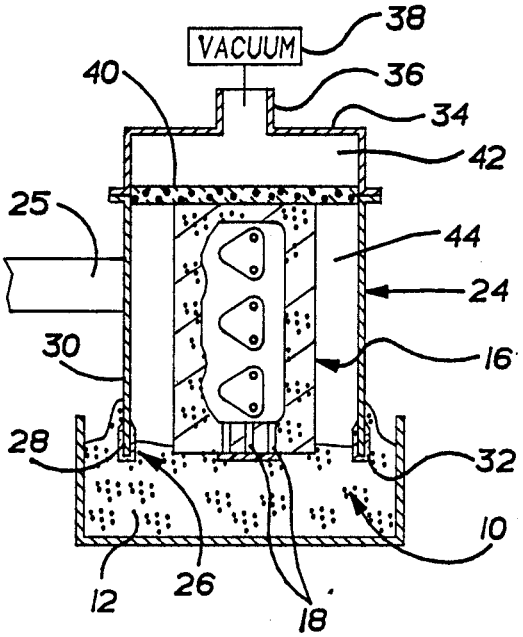

Referring to FIG. 1C, a gas impermeable, metal (e.g., steel) container 24 is shown disposed about the mold 16 with the open bottom end 26 of the container 24 proximate the molten metal inlets 18. The container 24 is typically carried on a vertically movable and horizontally pivotal arm 25 (e.g., see U.S. Pat. No. 4,340,108) and is lowered by the arm 25 toward the bed 10 to position the container 24 about the mold 16 with the open bottom end 26 positioned in (embedded in) the bed 10 when the container is lowered about the mold 16. As shown, the open bottom end 26 is formed by a bottom lip 28 on the peripheral wall 30 of the container 24. The bottom lip 28 may be coated with a ceramic layer 32 (or include a ceramic lip) for purposes to be explained hereinbelow.

The container 24 includes an upper end wall 34 having a conduit 36 that communicates with a vacuum source 38 (shown schematically), such as a vacuum pump. A gas permeable, particulate barrier or septum 40 (e.g., the porous ceramic plate shown or, alternately, a 100 mesh metal screen) is disposed generally horizontally in the container 24 to form an upper vacuum chamber 42 and a lower, mold-receiving chamber 44 that is in direct communication with the bed 10 when the container 24 is lowered about the mold 16 as shown in FIG. 1C. The upper vacuum chamber 42 is communicated by the conduit 36 to the vacuum source 38. When the upper chamber 42 is evacuated, the lower chamber 44 is evacuated through the gas permeable septum 40.

Preferably, the container components (e.g., the walls 30,34 and the septum 40) are fastened or otherwise assembled together to form a unitary container 24 to eliminate the need for handling and clamping equipment used heretofore for multi-part containers, although multi-part containers can be used in practicing the invention.

As shown in FIG. 1C, the upper end of the mold 16 seats against the septum 40 (or other locator means in the container 24) when the container 24 is lowered about the mold with the open bottom end 26 embedded in the bed 10 proximate the inlets 18. This seating establishes a desired positional relationship between the open bottom end 26 and the underside 16a of the mold 16. Alternately, locators may be disposed in the bed 10 for engaging the mold 16 and the open bottom end 26 to achieve the desired positional relationship therebetween. To this same end, removable locators (not shown) may be provided on the mold 16 in such a manner as to engage and properly position the open bottom end 26 relative thereto.

Embedding of the open bottom end 26 in the bed 10 establishes a vacuum seal about the bottom lip 28 adequate to permit sufficient evacuation of the chambers 42,44 to draw the particulate mold material 12 into the chamber 44 about the mold 16 as will be explained hereinbelow. Additional particulate mold material may be added to the bed 10 and mounded upwardly about the bottom lip 28, FIG. 1C, to enhance the vacuum sealing about the open bottom end 26 and also to provide a reservoir of particulate material about the mold 16.

Figure 1D:
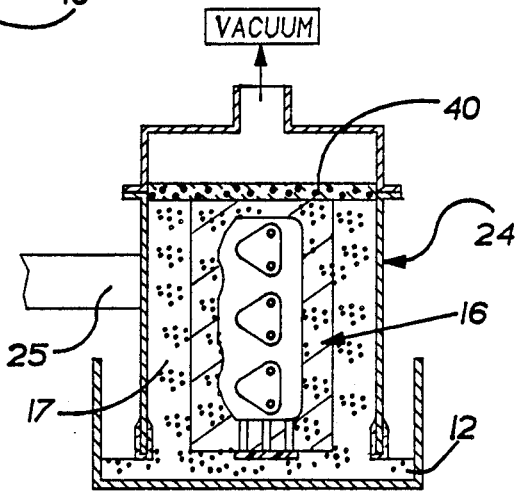

Following lowering of the container 24 about the mold 16, the upper and lower chambers 42,44 of the container are evacuated sufficiently by actuation of vacuum source 38 to draw the particulate mold material 12 upwardly from the underlying bed 10 into the container 24 to fill the interior (i.e., chamber 44) about the mold 16 as shown in FIG. 1D. A particulate mass 17 is thereby formed about the mold 16 in chamber 44. The amount of vacuum required will vary with the height and cross-sectional area of the lower chamber 44 and the size and weight of the particulate mold material 12 to be drawn into the chamber 44. The aforementioned destructible tape 19 adhered to the mold underside 16a seals the inlets 18 to prevent the particulate mold material 12 from being drawn into the inlets 18.

As explained in copending application Ser. No. 346,627, the size of the particulate material 12 is controlled to prevent its falling out of the open bottom end 26 of the container 24 on the one hand and being drawn into the septum 40 on the other hand. For a particular binderless, round silica sand particulate commonly used in casting iron and steel, particle sizes less than about 40 mesh AFS and larger than about 90 mesh AFS have proved satisfactory. A more preferred range of such sand particle sizes is about 40 mesh AFS to about 70 mesh AFS. The particular range of particle sizes useful for a particular casting application will depend on the type and shape of the particulate material 12 used, the pore size of the gas permeable septum 40 and the vacuum level established in the upper chamber 42.

By way of illustration of the present invention and not limitation, a vacuum level of 220 inches of water has been successfully used to vacuum suction the aforementioned round silica sand of 50 mesh AFS and aggregate weight of 180 lbs into the lower chamber 44 (width 17.5 inches, length 17.5 inches and height 26 inches) to fill the chamber 44 with a particulate mass 17 about a casting mold 16 therein. The net volume (i.e., the total volume of chamber 44 minus the volume of mold 16)

filled was 3245 cubic inches. The time to fill the net volume with the silica sand was 9 seconds.

The particulate-filled container 24 is illustrated in FIG. 1D. By comparing FIGS. 1C and 1D, it is apparent that the container 24 and the mold 16 move downwardly as the particulate material 12 is vacuum suctioned into the lower chamber 44 about the mold 16. Typically, the container 24 is lowered by arm 25 during filling of the container 24 with the particulate material 12 to allow the container 2 to follow the downward movement of the mold 16 during filling. The additional particulate material mounded upwardly about the bottom lip 28 of the container 24, see FIG. 1C, is gravity fed to the lower portion of the bed 10 to replenish particulate material as the chamber 44 is drawn upwardly from the bed 10.

Since vacuum suctioning of the particulate material 12 into the chamber 44 exerts a "settling" or compacting action on the particulate material 12 drawn about the mold 16, supplemental vibration station/equipment is not required in practicing the method of the invention.

Figure 1E:
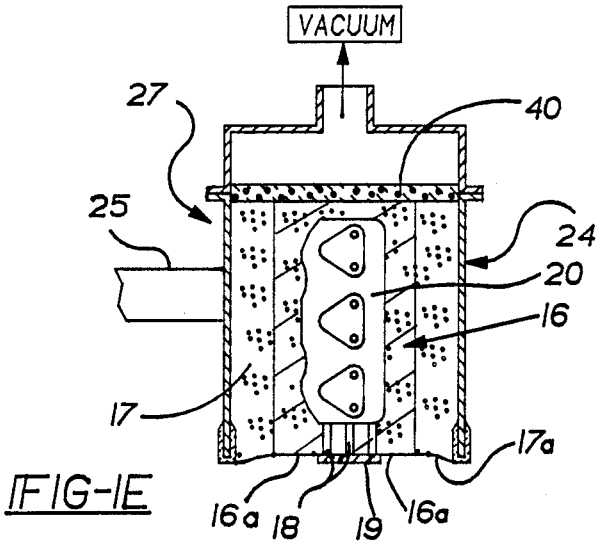

After the interior chamber 44 of the container 24 is filled with the particulate material 12 about the mold 16, the particulate-filled container 24 is raised upwardly (by the arm 25) to separate the chamber 44 from communication with the particulate bed 10, FIG. 1E. However, before the particulate-filled container 24 is raised away from the bed 10, a vacuum is applied in chambers 42,44 at least sufficient to exert an upward force on the bottom sides **16*a*,17*a* of the mold 16 and the particulate mass 17, respectively, which is at least equal to the combined weight of the mold 16, mass 17 and the metal which will be cast into the mold 16 and also to draw molten metal upwardly into the mold cavity 20 during the subsequent casting step. A vacuum level in the upper chamber 42 of about 220 inches of water has been used to successfully hold the resin-bonded sand mold 16 (about 215 lbs) and the surrounding sand mass 17 (about 180 lbs. and 50 mesh AFS) before, during and after filling mold cavity 20 with molten metal (about 55 lbs.) without the mold 16 or particulate mass 17 falling out of the open bottom end 26 and without the need for a separate mechanism to support the mold 16 in the chamber 44. That is, the negative pressure differential between the interior and exterior of the container 24 created by evacuation of chambers 42,44 constitutes the sole means for holding the mold 16 and mass 17 in the container 24**.

Typically, in practicing the method of the invention, the vacuum level previously established in chamber 42 to fill the chamber 44 with the particulate material 12 is simply continued upon raising of the particulate-filled container 24 from the bed 10 to hold the mold 16 and the particulate mass 17 in the chamber 44 as well as to countergravity fill the mold 16 with molten metal. A sheet (not shown) of aluminum foil or other material of reduced gas permeability may optionally be positioned on the bottom sides **16*a*,17*a* to enhance the vacuum holding action and also to seal off inlets 18 as described hereinabove. The sheet is subsequently destroyed/removed when the bottom sides 16*a*,17*a* are immersed in the molten metal pool 50** for casting.

Figure 1F:
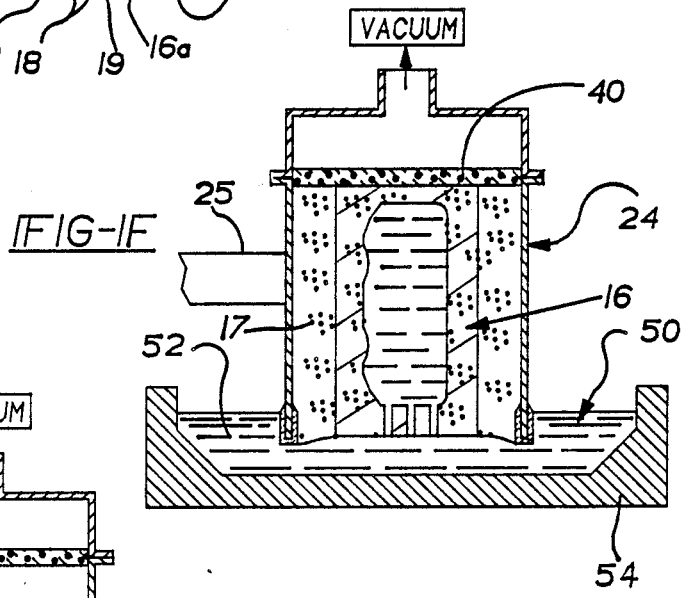

The particulate-filled container 24 (forming a casting assembly 27) is then transferred by the arm 25 to a position above a pool 50 of molten metal 52 contained in a suitable melt-holding vessel 54 for countergravity casting. In particular, the particulate-filled container 24 is lowered by arm 25 to immerse the molten metal inlets 18 in the pool 50 while a sufficient vacuum (typically the same level of vacuum as used to fill the chamber 44 with sand) is provided in the chambers 42,44 to draw the molten metal 52 upwardly from the pool 50, through the inlets 18 and into the mold cavity 20 for solidification therein. During and/or after the mold 16 is immersed in the pool 50, the destructible tape 19 sealing the inlets 18 is destroyed by the heat of the molten metal to allow the molten metal 52 to be drawn upwardly through the inlets 18 into the mold cavity 20. If the bottom sides **16*a*,17*a* are covered by a sheet of aluminum foil, the foil melts upon immersion in the pool 50. The ceramic layer 32 referred to hereinabove is provided on the bottom lip 28 of the container 24 to protect it from attack during immersion in the pool 50, as shown in FIG. 1F. The ceramic layer 32 may comprise a natural graphite based compound that is available under the name MEXADIP from McClain Corporation, Woodstock, Ill., and that prohibits any slag in the pool 50 from wetting and adhering to the ceramic layer 32**.

Alternatively, as disclosed in aforementioned copending application Ser. No. 346,627, the bottom sides **16*a*,17*a* of the mold 16 and sand mass 17 can be shaped to extend beyond (i.e., below) the open bottom end 26 of the container 24 such that only the bottom sides 16*a*,17*a* are required to be immersed in the pool 50 in order to immerse the molten metal inlets 18 during the casting operation. No portion of the container peripheral wall 30 is immersed in the pool 50. Moreover, in lieu of immersing the bottom sides 16*a*,17*a* in the pool 50, a downwardly extending fill tube or sprue defining a molten metal inlet (not shown) may be provided on the bottom of the mold 16 for sole immersion in the pool 50 during the casting operation; e.g., as also disclosed in aforementioned application Ser. No. 346,627. In these situations, the open bottom end 26 of the container 24 is considered proximate or adjacent to the molten metal inlets 18 even though the bottom sides 16*a*,17*a*** or the fill tube extend therebelow.

After solidification of the molten metal 52 in the mold 16, the particulate and metal-filled container 24 is raised out of the pool 50 by arm 25. During this operation, the vacuum is maintained in the upper and lower chambers 42,44 to hold the particulate mass 17 and the metal-filled mold 16 in the chamber 44. For casting certain large size castings, the particulate and metal-filled container 24 may be raised away from the pool 50 after initial solidification of the molten metal in the inlets 18 while the molten metal in the mold cavity 20 is still molten. The number and size of the inlets 18 to achieve metal solidification at the inlets 18 will vary with the type of the article to be cast and the particular metal to be cast as explained in U.S. Pat. No. 4,340,108, the teachings of which are incorporated herein by reference.

Alternately, the particulate and metal-filled container 24 may be raised away from the pool 50 immediately after filling the mold cavity 20 with the molten metal 52 and prior to solidification of the molten metal in the inlets 18 or mold cavity 20 while maintaining the vacuum in chambers 42,44. To this end, the inlets 18 are of preselected constricted size such that the molten metal surface tension in the inlets 18 coacts with the negative pressure differential between the interior and exterior of the container 24 to hold the molten metal in the inlets 18 as well as mold cavity 20 thereabove after removal of the metal-filled container from the pool 50. Typically, the molten metal will solidify rapidly in the inlets 18 after removal of the mold 16 from the pool 50. The solidified metal in the inlets 18 thereafter prevents run-out of the molten metal in the mold cavity 20.

Figure 1G:
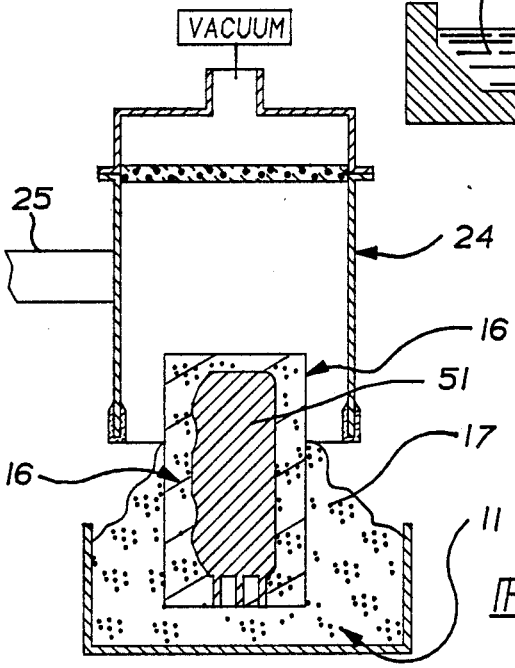

Following withdrawal of the particulate and metal-filled container 24 from the pool 50 and solidification of the molten metal therein, the container 24 is transferred to an unload station where the open bottom end 26 is set on a loose, dry, particulate bed 11 (e.g., binderless silica sand), FIG. 1G. The vacuum in the chambers 42,44 is then released to provide atmospheric pressure in chambers 42,44. This equalization of the pressure inside and outside the container 24 releases the metal-filled mold 16 and the particulate mass 17 for separation from the container 24. The container 24 is typically lifted upwardly away from the mold 16 and the particulate mass 17 to expose the mold 16 and the particulate mass 17 for further processing; e.g., shake-out of the casting 51. The container 24 is then moved by arm 25 to the position shown in FIG. 1C to repeat the sequence described hereinabove.

FIGS. 2A through 2E illustrate another embodiment of the method of the invention that employs a generally U-shaped receptacle 60 for the particulate material 62 (e.g., binderless silica foundry sand). The receptacle 60 includes a central portion **60*a*, upstanding side hoppers or reservoirs 60*b* and slide gates 60*c* separating the central portion 60*a* from each side hopper 60*b*. The particulate material 62 is introduced into the receptacle 60 through the open top of one or both of the hoppers 60*b* with the slide gates 60*c* closed to prevent particulate material 62 from entering the central portion 60*a*. The hoppers 60*b* are filled to such an extent as to provide upstanding reservoirs of particulate material 62 adjacent the central portion 60*a***.

Figure 2A:
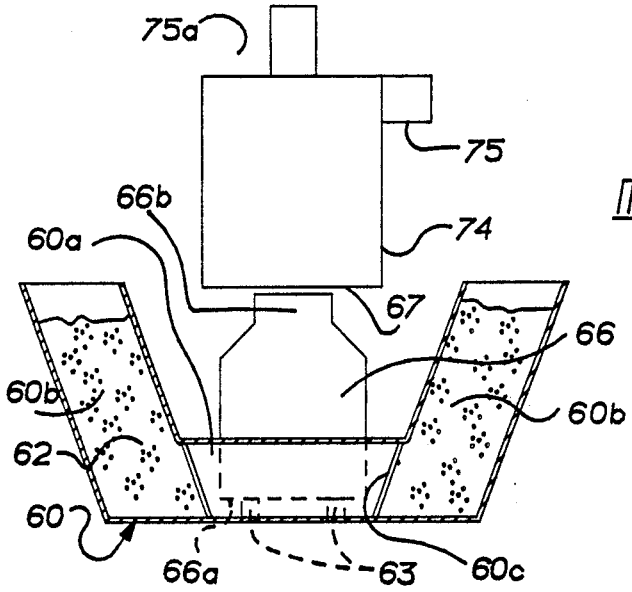
FIGS. 2A through 2E are sectioned elevational views, taken along lines 2—2 of FIG. 3, illustrating another embodiment of the method of the invention.
Figure 2B:
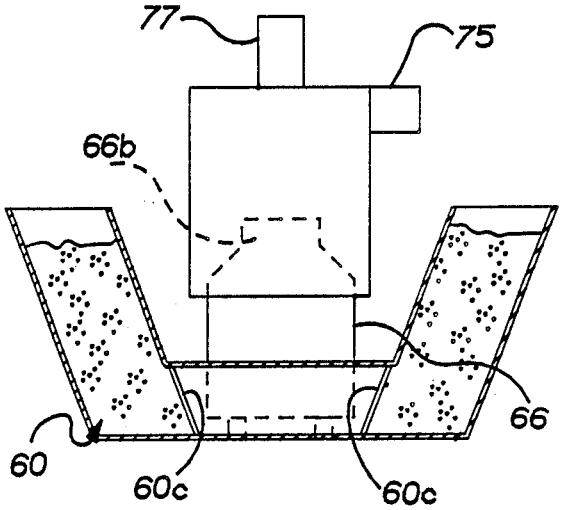
Figure 2C:
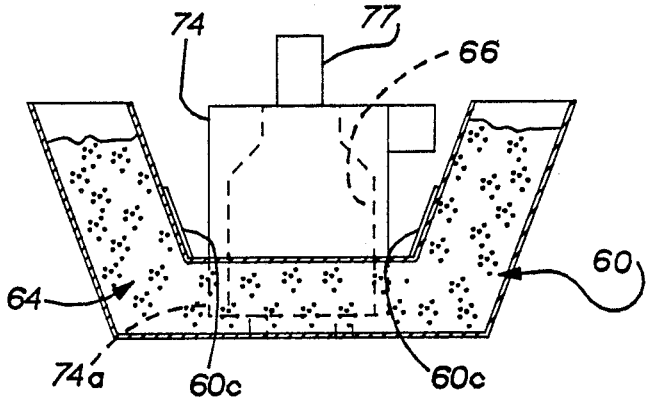
Figure 2D:
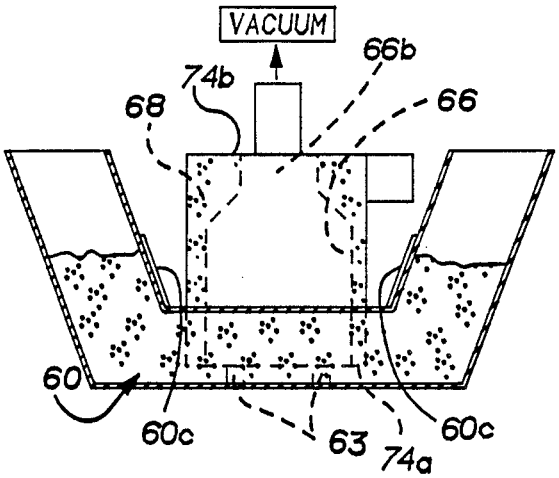
Figure 2E:
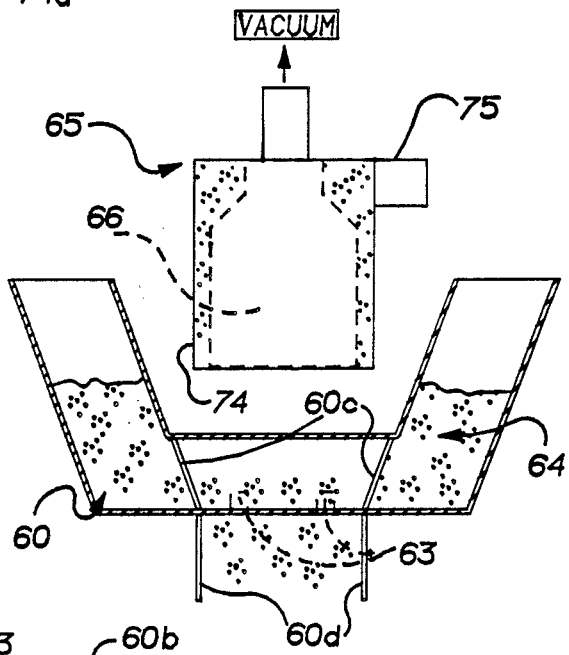
Figure 3:
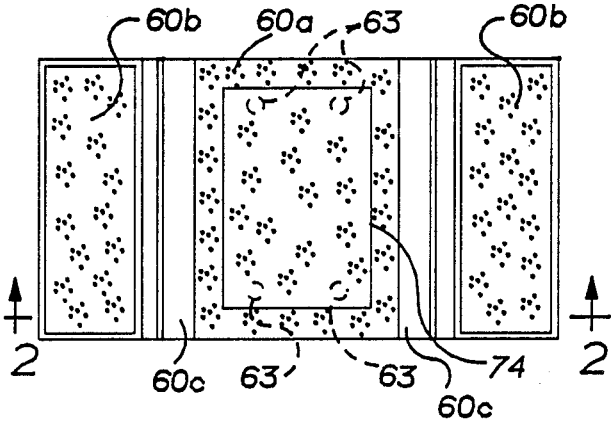
FIG. 3 is plan view of the apparatus shown in FIG. 2C.

As shown in FIG. 2A, the gas permeable, resin-bonded casting mold 66 is positioned on stationary mold supports 63 with the underside **66*a* of the mold 66 supported on the mold supports 63. The mold supports 63 are arranged in a rectangular pattern in the central portion 60*a*, see FIG. 3, for this purpose. The molten metal inlets (not shown) of the mold 66 are sealed as described hereinabove prior to placing the underside 66*a* on the supports 63. The container 74 is then lowered by the arm 75 (similar to arm 25 described hereinabove) about the mold 66, FIG. 2B. The slide gates 60*c* are then opened to allow the particulate material 62 in the side hoppers container 74 such that the open bottom end 74*a* thereof is embedded in the bed 64 for vacuum sealing purposes. The interior of the container 74 then is sufficiently evacuated (with the slide gates 60*c* open) to draw the particulate material 62 into the container 74 about the mold 66, FIG. 2D, and form the particulate mass 68 surrounding the mold 66. To this end, the mold 66 includes a gas permeable top portion 66*b* seated against the end wall 74*b* of the container such that the interior of the container and the mold cavity (not shown) can be evacuated through the top portion 66*b*. As the container 74 is filled, the particulate material 62 in the hoppers 60*b* is gravity fed through the open slide gates 60*c* to the central portion 60*b* to maintain the particulate level therein above the open bottom end 74*a* of the container 74 which, as mentioned above, does not move downwardly during container filling. After the container 74 is filled with the particulate material 62 about the mold 66, the slide gates 60*c* are closed. The particulate-filled container 74 (forming a casting assembly 65) is then raised from the central bed portion 60*b* (with the vacuum continued in the container 74) and positioned above a molten metal pool for immersion therein in a manner similar to that shown in FIG. 1F to effect countergravity casting. Any remaining particulate material 62 in the central portion 60*a* is discharged therefrom using bottom doors 60*d* below the supports 63, FIG. 2E. The discharged particulate material 62 can then be returned to the side hoppers 60*b***.

Figure 4A:
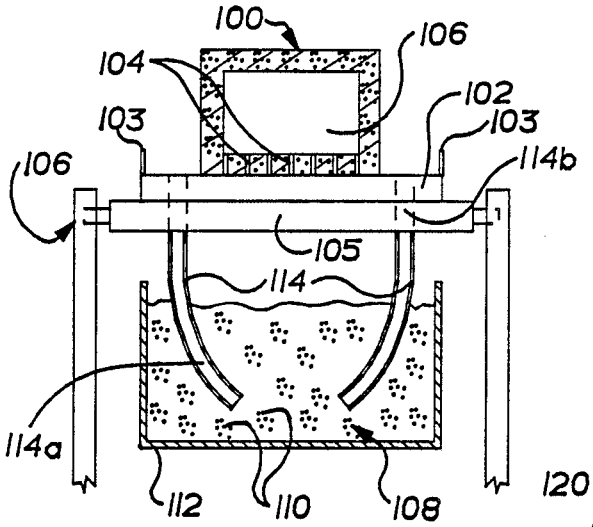
FIGS. 4A through 4D are sectioned elevational views illustrating still another embodiment of the invention.
Figure 4B:
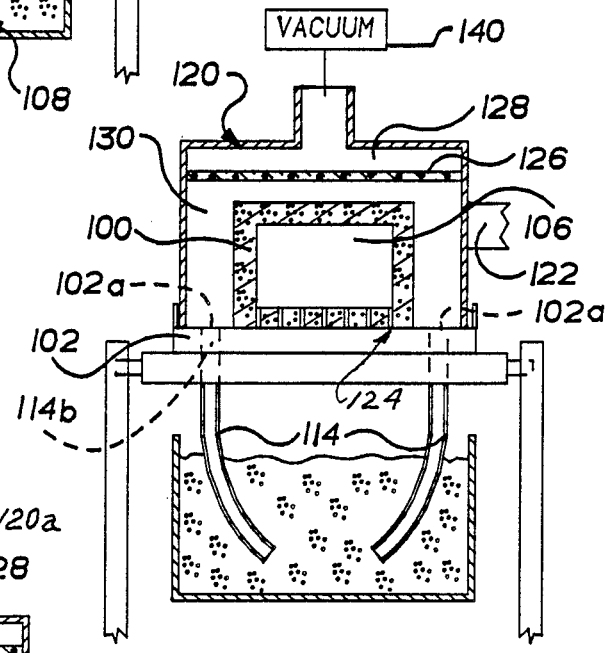
Figure 4C:
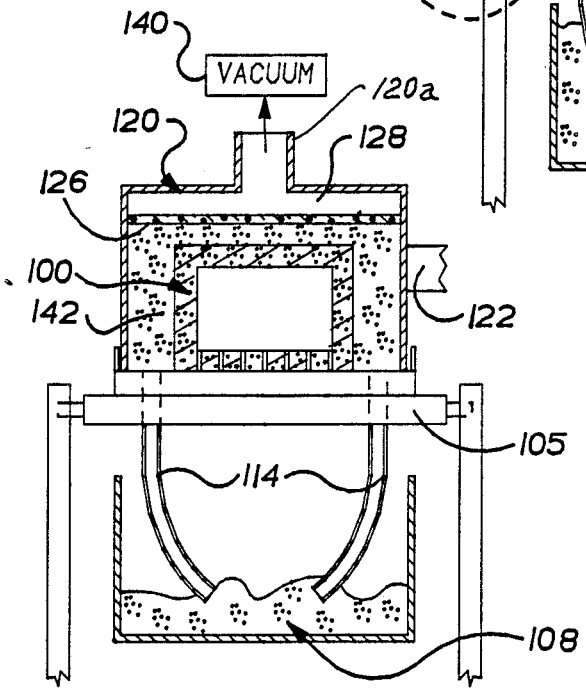
Figure 4D:
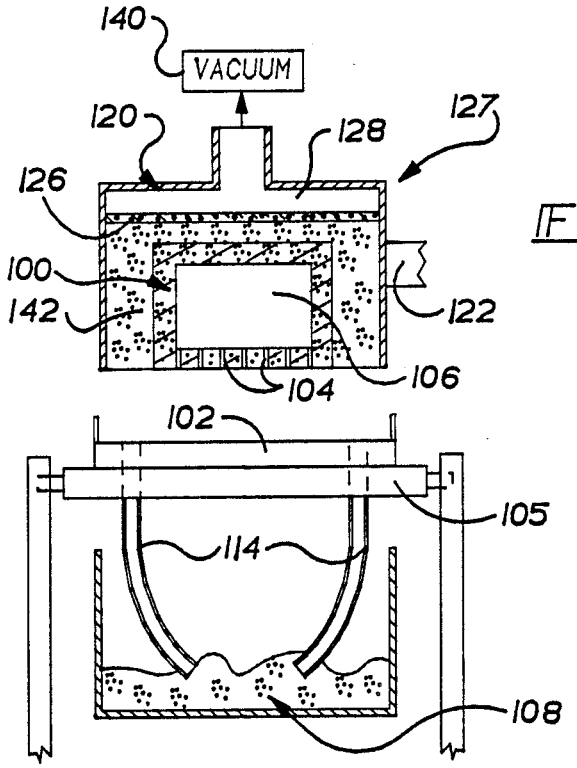

FIGS. 4A through 4D illustrate still another embodiment of the method of the invention. Referring to FIG. 4A, a resin-bonded, gas permeable, self-supporting casting mold 100 is shown initially positioned on a plate 102 with the molten metal inlets 104 disposed beneath the mold cavity 106 and closed off by the plate 102. The plate 102 is disposed on the rolls 105 (one shown) of a conventional roller conveyor 106 for movement into position above the bed 108 of particulate material 110 contained in the receptacle 112. Suction hoses 114 include lower ends **114*a* disposed in the bed 108 and upper ends 114*b* which are releasably fastened to the plate 102 when the plate 102 is positioned over the bed 108. The plate 102 includes first and second apertures 102*a* in communication with a respective one of the suction hoses 114 when they are fastened to the plate 102**.

After the plate 102 is positioned above the bed 108 and the upper ends **114*b* of the suction hoses 114 are fastened to the plate 102, the gas-impermeable container 120 is lowered by arm 122 about the mold 100 on the plate 102 With the open bottom end 124 substantially sealingly disposed on the plate 102. Locators 103 on the plate 102 aid in positioning the container 120 in desired position. The container 120 includes a generally horizontal gas permeable septum 126 (similar to septum 40 of FIGS. 1C–1F) forming an upper vacuum chamber 128 and a lower chamber 130 for receiving the mold 100 as shown best in FIG. 4B where it is apparent that the lower chamber 130 is in communication with the bed 108 of the particulate material 110 Via the suCtion hoses 114** interposed therebetween.

After the container 120 is disposed about the mold 100, upper and lower chambers 128,130 are evacuated by the vacuum source 140 connected to the conduit **120*a* of the container 120. The level of evacuation of chambers 128,130 is selected sufficient to draw the particulate material 110 (e.g., binderless silica foundry sand) from the bed 108 through the suction hoses 114 and into the chamber 130 about the mold 100 to form the particulate mass 142 about the sides and top of the mold 100, FIG. 4C**.

Once the chamber 130 is filled with the particulate material 110, the suction hoses 114 are disconnected from the plate 102 with a sufficient vacuum maintained in chambers 128,130 to hold the bed 142 and the mold 100 in the container 120 when the particulate-filled container 120 is raised by arm 122 from the plate 102. The plate 102 is held or otherwise remains of its own weight on the conveyor 106, FIG. 4D, when the particulate-filled container 120 is raised. The particulate-filled container 120 (forming a casting mold assembly 127) is then positioned by the arm 122 over the molten metal pool 50 for immersion therein in a manner similar to that shown in FIG. 1F for countergravity casting. After casting, the particulate and metal-filled mold is moved to the unload station to separate the container 120 from its contents as described hereinabove with respect to FIG. 1G.

In the above-described embodiment, a plurality of plates 102 can be placed in line on the conveyor 106 with a mold 100 successively mounted on each plate 102 at a plate load station. Each plate 102 with a mold 100 thereon then would be successively rolled above the bed 108 where the suction hoses 114 are connected to plate 102, the container 120 is lowered about the mold and vacuum filled with the particulate material 110 in the manner described hereinabove. After each particulate-filled container 120 is removed from its plate 102, that plate can be returned to the load station for receiving another mold 100 thereon to repeat the sequence.

FIGS. 5A through 5E illustrate still another embodiment of the method of the invention similar to that described hereinabove with respect to FIGS. 1A–1G but with a destructible pattern 200 (e.g., a polystyrene pattern) used in lieu of the casting mold 16 to define a metal-receiving mold cavity and molten metal inlet in the particulate mass 17. In particular, the destructible pattern 200 includes an upper portion **200*a* for forming a mold cavity in the shape of the article to be cast and a lower portion 200*b* for forming molten metal inlets beneath the mold cavity. In FIGS. 5A through 5D, like features of FIGS. 1A through 1G** are represented by like reference numerals.

In accordance with this embodiment of the invention, the pattern 200 is first placed on the bed 10 of particulate material 12 with the lower inlet-forming portion **200*b* disposed on the bed 10. The container 24 is then lowered about the pattern 200 with the open bottom end 26 embedded in the bed 10 for vacuum sealing purposes, FIG. 5B. A sufficient vacuum is then established in chambers 42,44 to draw the particulate mold material 12 into the chamber 44 about the pattern 200 to form a particulate mass 17 thereabout, FIG. 5C. The casting assembly 29 so formed (i.e., the destructible pattern 200 and the surrounding particulate mass 17 held in the open bottom container 24**) is of the type shown in copending application Ser. No. 191,544 of common assignee herewith, the teachings of which are incorporated herein by reference.

Figure 5A:
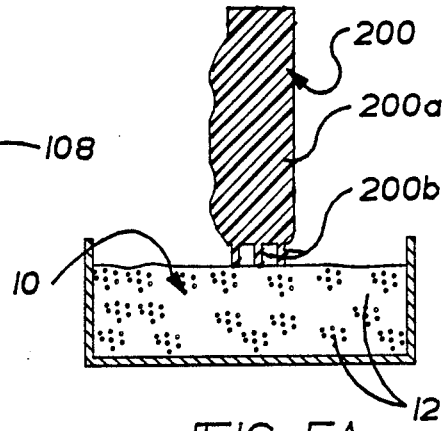
FIG. 5A through 5E are sectioned elevational views illustrating a further embodiment of the invention which employs a destructible pattern in lieu of a self-supporting casting mold as the mold cavity and inlet forming means.
Figure 5B:
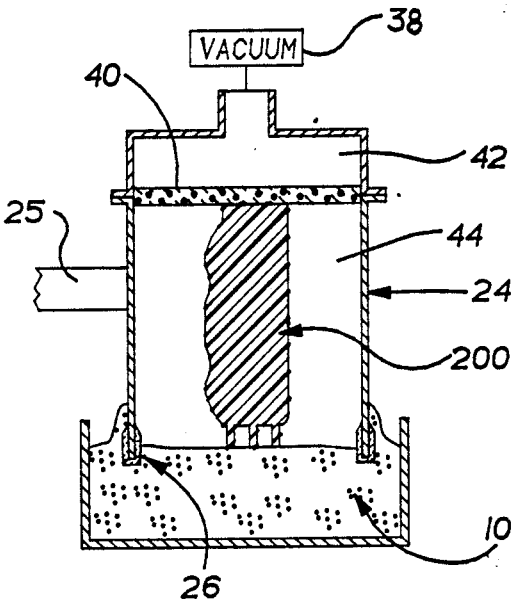
Figure 5C:
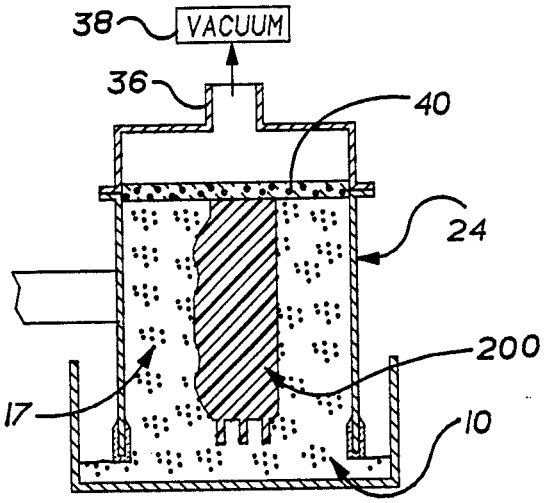
Figure 5D:
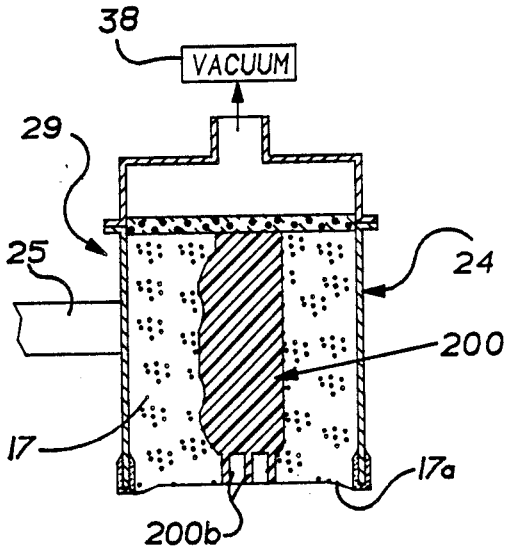
Figure 5E:
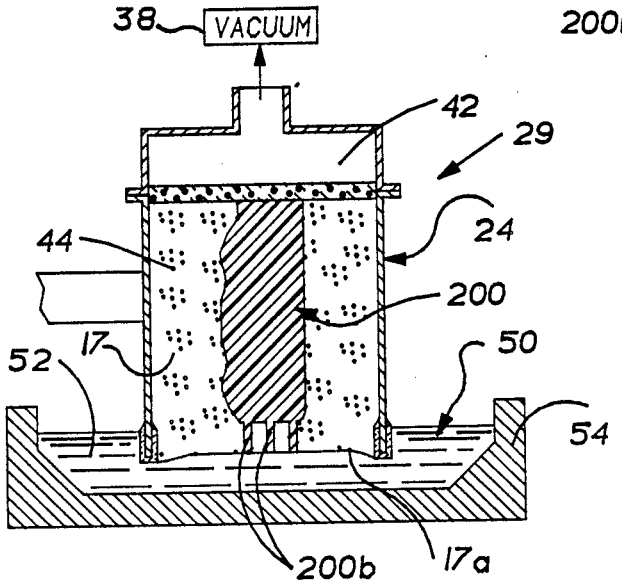

The particulate-filled container 24 is then raised from the bed 10 to separate the chamber 44 from communication with the bed 10, FIG. 5D. Concurrently, a sufficient vacuum is provided in chambers 42,44 to hold the particulate mass 17 and the pattern 200 in the container 24. The particulate-filled container 24 is then positioned above the molten metal pool 50 for immersion therein as shown in FIG. 5E where the bottom side **17*a* of the particulate mass 17 and the lower inlet-forming portion 200*b* of the pattern 200 are immersed in the pool 50. As the molten metal 52 is drawn and advanced upwardly by the vacuum in chambers 42,44, the molten metal vaporizes the polystyrene pattern 200 and replaces the pattern 200 in the particulate mass 17**.

Upon solidification of the molten metal in the particulate mass 17, the particulate and metal-filled container 24 is raised from the pool 50 and moved to an unload station where the vacuum in chambers 42,44 is released in the manner described hereinabove with respect to FIG. 1G.

Although the embodiments of the invention have been described hereinabove with respect to use of a bed of loose, substantially binderless foundry sand, the particulate material may instead be weakly bonded using a small amount of binder (i.e., less than 0.3% by weight of the sand-resin mix depending on the binder) as disclosed in aforementioned copending Ser. No. 191,544. The weakly bonded particulate material would be vacuum suctioned about the casting mold or destructible pattern into the open bottom container and then cured or hardened in-situ in the container. Moreover, although the casting mold or destructible pattern and the surrounding particulate bed are described as being held in the container solely by a negative pressure differential between the interior and exterior of the container, the casting mold or pattern itself may be held in the container by a suitable support mechanism (e.g., as disclosed in aforementioned copending applications Ser. No. 191,544 and Ser. No. 346,627) while the particulate mass is held thereabout in the container by the negative pressure differential.

While the invention has been described in terms of specific preferred embodiments thereof, it is not intended to be limited thereto but rather only to the extent set forth hereafter in the following claims.

We claim:

1. A method of countergravity casting of molten metal, comprising the steps of:

(a) disposing a container about means for forming a metal-receiving mold cavity and a molten metal inlet beneath the mold cavity such that an open bottom end of the container is disposed proximate the inlet, (b) communicating the interior of the container to a source of particulate mold material, (c) evacuating the interior of the container sufficiently to so draw the particulate mold material into the container as to fill the container with said particulate mold material about the mold cavity and inlet forming means, (d) separating the particulate-filled container from communication with the source of particulate mold material, including sufficiently evacuating the interior of the container as to hold the particulate mold material in the container about the mold cavity and inlet forming means, (e) relatively moving the particulate-filled container and a pool of the molten metal to immerse said inlet in said pool, and (f) drawing the molten metal upwardly through said inlet into said mold cavity when said inlet is immersed in said pool.

2. The method of claim 1 wherein the mold cavity and inlet forming means comprises a gas permeable mold having the mold cavity therein and the inlet communicating an underside of the mold with the mold cavity.

3. The method of claim 2 including sealing the inlet prior to drawing the particulate material into the container so as to prevent the particulate material from being drawn into said inlet.

4. The method of claim 3 wherein the inlet is sealed with a material that is destroyed in step (e) to allow molten metal to be drawn through the inlet in step (f).

5. The method of claim 1 wherein the mold cavity and inlet forming means comprises a destructible pattern that is destroyed by the molten metal in step (f), said pattern having an upper portion for forming said mold cavity and a lower portion for forming said inlet in the particulate mold material as the pattern is destroyed.

6. The method of claim 1 wherein the interior of the container is communicated to said source in step (b) by placing the open bottom end of the container in an underlying bed of the particulate mold material such that the particulate mold material provides a vacuum seal about said open bottom end.

7. The method of claim 6 wherein the mold cavity and inlet forming means is set on the bed of particulate mold material and then said container is disposed about the mold cavity and inlet forming means with the open bottom end embedded in the bed.

8. The method of claim 6 including providing an upstanding reservoir of the particulate mold material adjacent the bed to gravity feed the particulate mold material to the bed as the particulate mold material is drawn into the container.

9. The method of claim 1 wherein the interior of the container is communicated to said source in step (b) by placing the mold cavity and inlet forming means on support means, positioning the container about the mold cavity and inlet forming means and forming a bed of particulate mold material about the open bottom end of the container.

10. The method of claim 9 wherein said bed is formed by gravity feeding the particulate mold material about the open bottom end.

11. The method of claim 1 wherein the interior of the container is communicated to said source in step (b) by interposing a suction hose between the source and the interior of the container.

12. The method of claim 11 wherein the suction hose extends between the source of the particulate mold material and a support plate on which the open bottom end of the container is sealingly disposed.

13. The method of claim 12 wherein the source of particulate mold material is disposed below said plate.

14. The method of claim 1 including the further step after step (d) of terminating evacuation of the interior of the container at an unload station to release the particulate mold material and solidified metal casting for removal from said container.

15. A method of countergravity casting of molten metal, comprising the steps of:

(a) disposing a container about a mold having a metal-receiving mold cavity and a molten metal inlet beneath the mold cavity such that an open bottom end of the container is disposed proximate the inlet, (b) communicating the interior of the container to a source of sand, (c) evacuating the interior of the container sufficiently to so draw the sand into the container as to fill the container with said sand about said mold, (d) separating the sand-filled container from communication with the source of sand, including sufficiently evacuating the interior of the container as to hold the sand in the container about the mold, (e) relatively moving the sand-filled container and a pool of the molten metal to immerse said inlet in said pool, and (f) drawing the molten metal upwardly through said inlet into said mold cavity when said inlet is immersed in said pool.

16. A method of countergravity casting of molten metal, comprising the steps of:

(a) disposing a container about a destructible pattern having an upper portion for forming a metal-receiving mold cavity and a lower portion for forming a molten metal inlet beneath the mold cavity such that an open bottom end of the container is disposed proximate the inlet-forming portion, (b) communicating the interior of the container to a source of sand, (c) evacuating the interior of the container sufficiently to so draw the sand into the container as to fill the container with said sand about said pattern, (d) separating the sand-filled container from communication with the source of sand, including sufficiently evacuating the interior of the container as to hold the sand in the container about the pattern, (e) relatively moving the sand-filled container and a pool of the molten metal to immerse said inlet-forming portion in said pool, and (f) drawing the molten metal upwardly through the inlet and into the mold cavity formed as said pattern is destroyed by upward advance of the molten metal.

17. A method of making a casting assembly, comprising the steps of:

(a) disposing a container about means for forming a metal-receiving mold cavity and a molten metal inlet beneath the mold cavity such that an open bottom end of the container is disposed proximate the inlet, (b) communicating the interior of the container to a source of particulate mold material, (c) evacuating the interior of the container sufficiently to so draw the particulate mold material into the container as to fill the container with said particulate mold material about the mold cavity and inlet forming means, and (d) separating the particulate-filled container from communication with the source of particulate mold material, including sufficiently evacuating the interior of the container as to hold the particulate mold material in the container about the mold cavity and inlet forming means.

18. The method of claim 17 wherein the mold cavity and inlet forming means comprises a gas permeable mold having the mold cavity therein and the inlet communicating an underside of the mold with the mold cavity.

19. The method of claim 16 including sealing the inlet prior to drawing the particulate material into the container so as to prevent the particulate material from being drawn into said inlet.

20. The method of claim 19 wherein the inlet is sealed with a material that is destroyed in step (e) to allow molten metal to be drawn through the inlet in step (f).

21. The method of claim 17 wherein the mold cavity and inlet forming means comprises a destructible pattern, said pattern having an upper portion for forming the mold cavity and a lower portion for forming the inlet in the particulate mold material as the pattern is destroyed therein.

22. The method of claim 17 wherein the interior of the container is communicated to said source in step (b) by placing the open bottom end of the container in an underlying bed of the particulate mold material such that the particulate mold material provides a vacuum seal about said open bottom end.

23. The method of claim 22 wherein said mold cavity and inlet forming means is set on the bed of particulate mold material and then said container is disposed about the mold cavity and inlet forming means with the open bottom end embedded in the bed.

24. The method of claim 22 including providing an upstanding reservoir of the particulate mold material adjacent the bed to gravity feed the particulate mold material to the bed as the particulate mold material is drawn into the container.

25. The method of claim 17 wherein the interior of the container is communicated to said source by placing the mold cavity and inlet forming means on support means, positioning the container about the mold cavity and inlet-forming means and forming a bed of particulate mold material about the open bottom end of the container.

26. The method of claim 17 wherein the interior of the container is communicated to said source in step (b) by interposing a suction hose between the source and the interior of the container.

27. The method of claim 26 wherein the suction hose extends between the source of particulate mold material and a plate on which the open bottom end of the container is sealingly disposed.

28. The method of claim 27 wherein the source of particulate mold material is disposed below said plate.

* * * * *

UNITED STATES PATENT AND TRADEMARK OFFICE

CERTIFICATE OF CORRECTION

PATENT NO. : 4,971,131

DATED : November 20, 1990

INVENTOR(S) : Charles P. Aubin et al

It is certified that error appears in the above-indentified patent and that said Letters Patent is hereby corrected as shown below:

Column 7, line 10, delete "2" and insert --24-- therefor.

Column 9, line 48, after "hoppers" insert --60b to fill the central portion 60a and surround the--.

Signed and Sealed this

Seventh Day of September, 1993

Bruce Lehman

*Attest:*

BRUCE LEHMAN

*Attesting Officer*

*Commissioner of Patents and Trademarks*